United States Patent [19]

Svirklys et al.

[11] Patent Number: 4,733,626

[45] Date of Patent: Mar. 29, 1988

[54] FLOTATION SYSTEM

[75] Inventors: Ferdinand M. Svirklys, Toronto; Peter G. Lancucki, Scarborough, both of Canada

[73] Assignee: Dominion A1-Chrome Corporation, Toronto, Canada

[21] Appl. No.: 927,866

[22] Filed: Nov. 7, 1986

Related U.S. Application Data

[63] Continuation of Ser. No. 701,997, Feb. 15, 1985, Pat. No. 4,655,156.

[51] Int. Cl.[4] ..... B63B 35/38

[52] U.S. Cl. ..... 114/267; 114/266

[58] Field of Search ..... 114/263, 264, 266, 267, 114/352, 77 A, 77 R; 405/219; 52/593, 589; 446/111, 113, 128; 428/159

[56] References Cited

U.S. PATENT DOCUMENTS 4,606,732 8/1986 Lyman ..... 446/128 X

FOREIGN PATENT DOCUMENTS 1290727 3/1962 France ..... 446/128

*Primary Examiner*—Joseph F. Peters, Jr.
*Assistant Examiner*—Paul E. Salmon
*Attorney, Agent, or Firm*—Sim & McBurney

[57] ABSTRACT

Floating structures, for example, for recreational aquatic activities, comprises a plurality of individual uniquely-constructed modular flotation units constructed to permit any desired freeboard dimension and/or buoyancy characteristics.

5 Claims, 8 Drawing Figures

222
220
218
40
212
16
216
14
210
215
222
214
18
224
20
10

222
216
216
214
220
42
218
42
210
42
42
10

10

FLOTATION SYSTEM

This is a continuation of application Ser. No. 701,997 filed Feb. 15, 1985, now U.S. Pat. No. 4,665,156.

FIELD OF INVENTION

The present invention relates to flotation systems comprising modular flotation units.

BACKGROUND TO THE INVENTION

Floating structures of various types are used for recreational aquatic activities, including docks, marinas and pontoons. Such structures generally comprise some form of a flotation means immersed partially or wholly in the water and some form of decking attached to the flotation means. The flotation means generally are customized for the particular structure and do not permit modification.

SUMMARY OF INVENTION

In accordance with the present invention, there is provided a modular floating unit which permits the construction of floating structures having any desired configuration, size and floating characteristics. The present invention also includes the floating structures produced from the individual flotation units, including docks, marinas and pontoons.

DESCRIPTION OF PREFERRED EMBODIMENT

Figure 1:
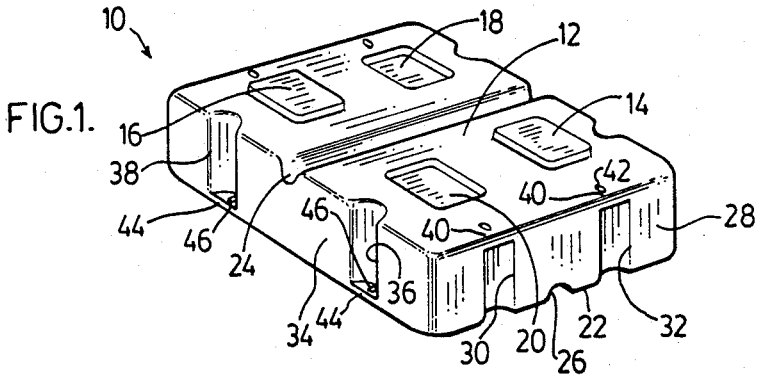
FIG. 1 is a perspective view from above of one form of modular flotation unit constructed in accordance with the invention.
Figure 2:
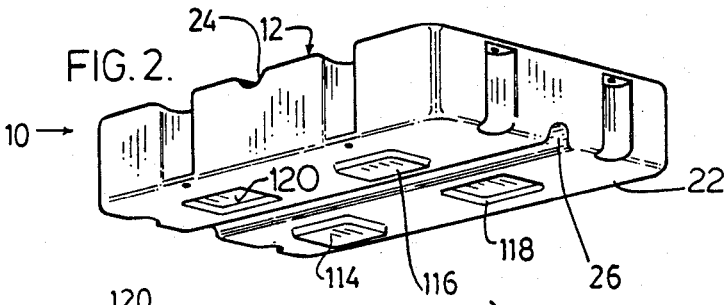
FIG. 2 is a perspective view from below of the flotation unit of FIG. 1.

Referring to the drawings, there are illustrated in FIGS. 1 and 2, two perspective views of a flotation unit constructed in accordance with one embodiment of the invention. As may be seen in FIG. 1, a flotation unit 10 has a generally cubic construction. The upper surface 12 has a pair of rectangular cross-sectioned protrusions 14, 16 arranged diagonally with respect to each other and a pair of rectangular cross-sectioned depressions 18, 20 arranged diagonally with respect to each other.

The undersurface 22 of the flotation unit 10 is provided also with pairs of diagonally-arranged protrusions 114, 116 and depressions 118, 120. The protrusions 14 and 16, therefore, are complemented by depressions 118 and 120 at the same locations on the undersurface 22 and the depressions 18 and 20 are complemented by protrusions 114, 116 at the same locations on the undersurface 22. The protrusions 14, 16, 114, 116 and the depressions 18, 20, 118, 120 are of the same lateral, longitudinal and depth dimensions. The arrangement and dimensioning of the protrusions and depressions permits multiples of the unit 10 to be stacked and interconnected one with another, as described below with respect to FIGS. 3 and 4.

Both the upper surface 12 and the lower surface 22 of the flotation unit 10 have a groove 24, 26 formed therein. Groove 24 extends from one lateral side edge to the other while groove 26 extends from one longitudinal side edge to the other. The groove 24, 26 bisect the area of the respective surface into two halves. This arrangement enables the depressions 24 and 26 of one flotation unit 10 to align with those of another flotation unit 10 when the units are side abutted to receive utility conduits.

Formed in each end wall 28 of the flotation unit 10 is a pair of part-circular depressions 30, 32 while formed in each side wall 34 is a pair of part-circular depressions 36, 38. The part-circular end-wall depressions 30, 32 are located in the same locations in each end wall 28 while similarly the part-circular side-wall depressions 36, 38 are located in the same location in each side wall 34.

The part-circular end-wall depressions 30, 32 extend for substantially the height of the end wall 28 and terminate at their upper end in a part-circular compression weld seal 40 integral with the adjoining portions of the flotation unit 10 and are open at the lower end. A bore 42 is formed through each seal 40.

The part-circular side-wall depressions 36, 38 extend for substantially the height of the side wall 34 and terminate at their lower end in a part-circular compression weld seal 44 integral with the adjoining portion of the flotation unit 10 and are open at the upper end. A bore 46 is formed through each seal 44.

Figure 3:
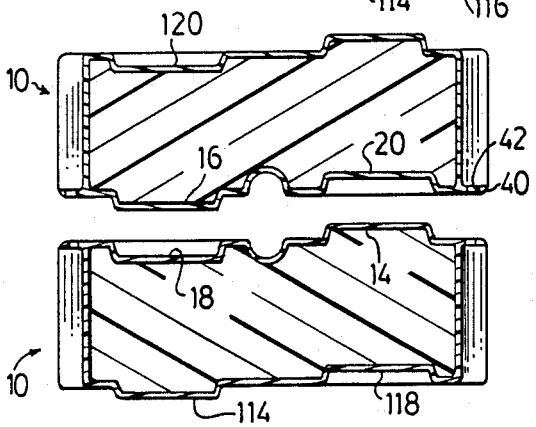
FIG. 3 is a sectional view of two of the units of FIGS. 1 and 2 in stacked relation.
Figure 4:
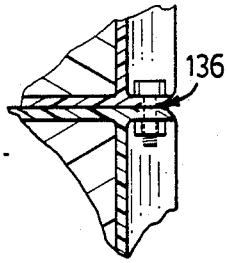
FIG. 4 is a detailed view of the manner of joining together the nested units of FIG. 3.

The stacking together of two of the flotation units 10 and the fastening together of the stacked units is illustrated in FIGS. 3 and 4. As seen therein, two flotation units 10 may be stacked one on another, with the upper unit 10 being turned upside down from the arrangement seen in FIGS. 1 and 2. The complementary locations of the projections 14, 16 and the depressions 18, 20 on the upper and lower surfaces of the flotation unit 10 and their diagonally-spaced locations enables the projections and depressions to be nested, thereby joining the flotation units together and preventing the face-abutted units 10 from relative lateral movement.

With the upper flotation unit 10 turned upside-down before stacking, the end wall compression seals 40 abut each other in the two units 10 with the bores 42 in alignment. This abutment of the seals 40 and alignment of the bores 42 permits the stacked units to be fastened together by the use of bolts 136 or similar fastening means passing through the aligned openings 42, as may be seen from the detail of FIG. 4.

Any desired number of the flotation units 10 may be formed into a stack, depending on the buoyancy characteristics desired. As greater numbers are added to the stack, the buoyancy increases. As discussed in detail below, this arrangement may be employed to provide a floating structure having varying buoyancy characteristics within the overall structure.

To add a third member to the stack, a further unit 10 is used in the orientation shown in FIGS. 1 and 2, if being stacked on the top of the stack or upside-down from the orientation of FIGS. 1 and 2, if being stacked on the bottom of the stack, whichever is the more convenient. The protrusions and depressions of the abutting faces nest with one another, as in the case of the first two members, as described above. In either case, i.e. stacked on the top or on the bottom, the side-wall compression seals 44 are in abutting relation, with the bores 46 in alignment. The third member of the stack is fastened to the other two members by bolts passing through the aligned bores 46, in analogous manner to that shown in the detail of FIG. 4 for the first two members 10 of the stack.

This operation can be repeated for any desired number of the flotation units 10 in the stack, with the vertically-adjacent units being fastened into the stack at either the top or bottom of the stack through the appropriate abutting seals. The units 10 in the stack alternate in orientation with respect to that shown in FIGS. 1 and 2, so as to provide the required adjacent location of seals to permit joining together of the units.

Stacks of units 10 may be provided in this manner with each stack containing the same number of flotation units or a variable number of units. Each stack has at the upper surface of the stack openings 42 which may be used as attachment points for stringers to enable multiple stacks of flotation units and/or individual flotation units to be joined in side-to-side or end-to-end abutted relationship. By the utilization of such stringers, floating structures of simple or complex shape with uniform or variable flotation characteristics, may be formed from the stacks of flotation units and from individual flotation units.

The individual flotation units 10 may be constructed of any desired material provides a buoyant structure. In one embodiment of the invention, the flotation units 10 are blow moulded as hollow units from a suitable thermoplastic or thermosetting polymeric material, for example, polyethylene and then filled with rigid polyurethane foam or other suitable foam material.

The flotation units 10 have a modular structure, as just described. The units 10 usually have common lateral and longitudinal dimensions and are the same as each other, for example, 2 feet×3 feet, although they may be provided with variable depth, to alter the flotation characteristics of the individual units, to provide further versatility in providing a floating structure having variable flotation characteristics, as may be seen in FIG. 5. Typically, the flotation units 10 may have a depth of 5 inches or 8 inches.

The multidirectional nature of the flotation units 10 as described above, permits floating structures of 2, 3, 4, 5 or more feet in width and length to be provided. The floating structures, therefore, can have an almost infinitely variable freeboard and/or buoyancy, without the necessity of expensive custom building, as used in the prior art. Once constructed from the flotation units 10, the floating structure is capable of further variation in freeboard and/or buoyancy, again in complete contrast to the prior art.

Figure 6:
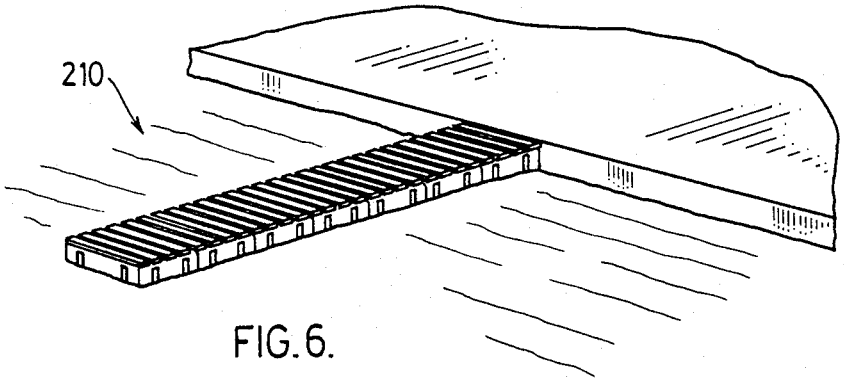
FIG. 6 is a perspective view of a floating dock structure embodying flotation units constructed in accordance with the present invention.
Figure 7:
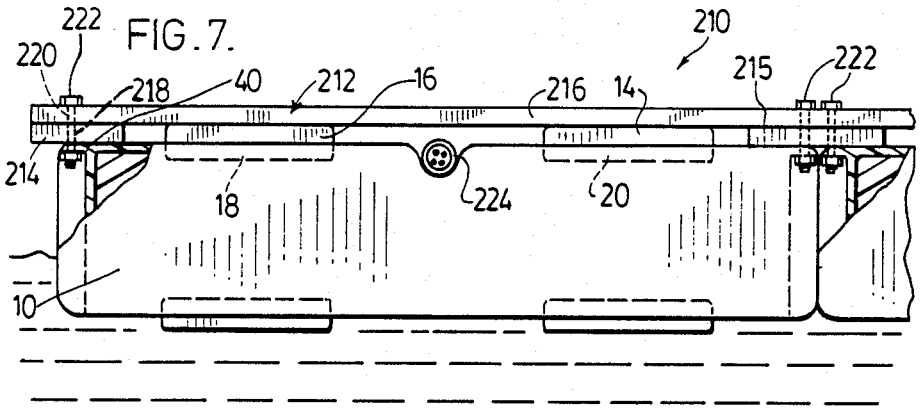
FIG. 7 is an end view of the floating dock of FIG. 6.
Figure 5:
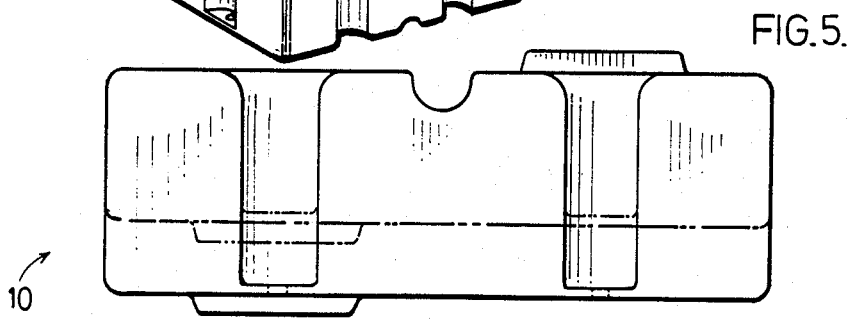
FIG. 5 is an end view of two of the flotation units, illustrating differing depths.

Turning now to consideration of FIGS. 5 to 7, there is illustrated therein a floating dock structure 210 formed from flotation units 10. The floating dock 210 comprises a plurality of flotation units 10 underlying a deck 212. The deck 212 comprises a pair of elongate stringers 214, 215 located at the sides of the floating structure and a plurality of transverse boards 216 extending for the width of the dock 210.

Figure 8:
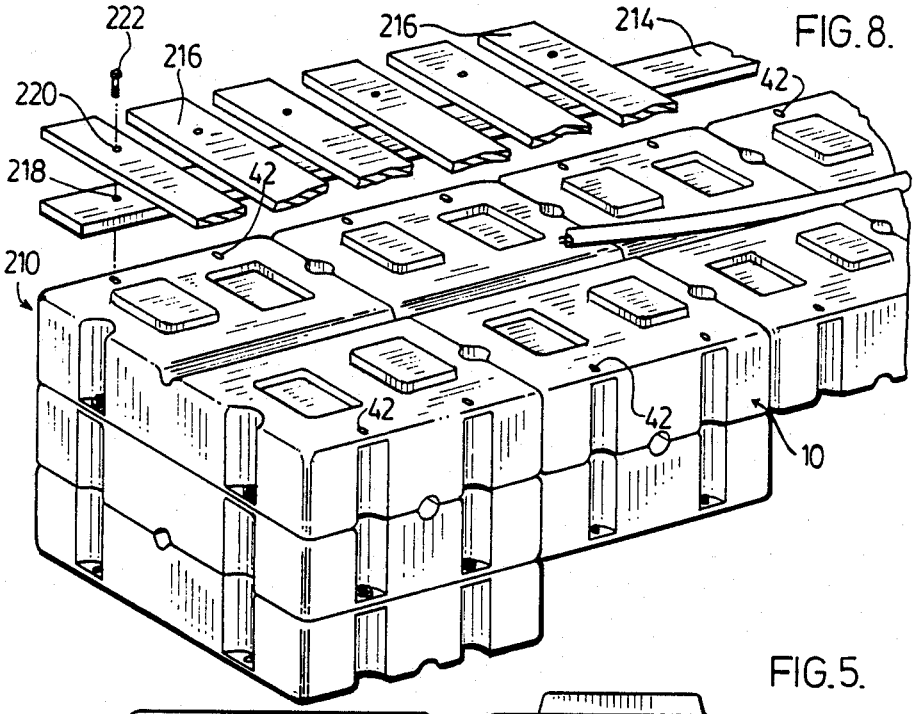
FIG. 8 is an exploded view of the dock structure of FIG. 6.

As may be seen particularly in FIG. 8, stacks of one, two, three or more flotation units 10 are located in side-face abutting relationship to define the basic shape of the dock 210. The structure illustrated in FIGS. 6 and 8 is a floating dock 210 having a width equal to the width of the individual units 10. It is apparent from the foregoing description that additional units 10 may be side-abutted to the end-faces of the floating structure, as illustrated in FIG. 7.

The openings 42 of the top-most units 10 of the side face-abutted individual units or stacks are located in straight-line alignment, to permit joining together of these elements in the manner now described. The stringers 214 are laid the length of the dock 210 over the horizontally-aligned openings 42. Bores 218 are provided through the stringers 214 in alignment with the openings 42. The transverse boards 216 are laid on top of the stringers 214 at the locations of the individual openings 42 and have openings 220 which align with openings 218 and 42. Bolts 222 then are passed through the openings 220 in the boards 216, openings 218 in the stringers 214 and openings 42 in the flotation units 10 at each location of opening 42 to assemble the dock structure.

As seen in FIG. 7, the side-abutted units are assembled with the main unit by extending the transverse boards 216 for the total width of the floating structure, providing double-width stringers 215 (or a pair of individual stringers 214) and using bolts 222 passing through the perspective aligned openings.

The grooves 24 of the abutting flotation units 10 are aligned in the dock structure 210 and may be used as a channel for utility or pipes 224, if desired.

It will be appreciated from the above description that additional stacks of flotation units may be end-face abutted to either side of the primary floating structure, with the cross-members 216 extending for the width of the resulting structure to act as stringers to join the end-abutting members together and thereby provide an overall tying together of the stacks.

The stacks of two flotation units 10 exhibit more buoyancy than a single flotation unit 10 and the buoyancy increases with increasing numbers of flotation units in a stack. By combining stacks of different numbers of flotation units and individual flotation units of varying depth in a single floating structure by the suitable use of stringers as described above, a floating structure may be provided which has differential areas of buoyancy, which may be used to support superstructures of differing weights at differing locations on the structure.

The modular nature of the flotation units of the present invention combined with their unique manner of nesting and attachment one to another provides a considerable versatility in the size, shape and buoyancy characteristics of floating structures to be achieved which has heretofore not been the case. The resulting floating structure may be employed for a variety of purposes, including recreational aquatic activities.

SUMMARY OF DISCLOSURE

In summary of this disclosure, the present invention provides a novel flotation unit and novel floating structures formed therefrom. Modifications are possible within the scope of the invention.

What we claim is:

1. A modular flotation unit useful for vertical assembly with other like flotation units to provide floating structures of desired buoyancy, comprising upper and lower generally planar surfaces each of which has a periphery;

nesting means associated with said surfaces to permit multiples of said flotation units to be stacked in face-abutting relation one on another in vertical alignment while inhibiting lateral movement of stacked units one with respect to another, said nesting means comprising a symmetrically-arranged pair of diagonally-spaced protrusions and pair of diagonally-spaced depressions on said upper surface and a symmetrically-arranged pair of diagonally-spaced protrusions and pair of diagonally-spaced depressions on said lower surface, said depressions being complimentarily-shaped with respect to said protrusions and the symmetrical arrangement on said upper surface being complimentary with the symmetrical arrangement on said lower surface, said symmetrical arrangement on both said upper and lower surfaces being located wholly within and spaced inwardly from the periphery of the respective upper and lower surfaces; and fastening means associated therewith to permit said multiple of stacked flotation units to be stably joined one to another in a vertical stack of at least two face-abutted units.

2. The flotation unit of claim 1 wherein two pairs of protrusion and depression means are provided in each said upper and lower surfaces located and arranged to permit said stacking of multiples of said flotation units.

3. The flotation unit of claim 1 wherein said fastening means comprises means establishing at least one connection point constructed to permit the connection point to be joined to the connection point on another flotation unit.

4. A modular flotation unit useful for vertical assembly with other like flotation units to provide floating structures of desired buoyancy, comprising upper and lower generally planar surfaces each of which has a periphery;

nesting means associated with said surfaces to permit multiples of said flotation units to be stacked in face-abutting relation one on another in vertical alignment while inhibiting lateral movement of stacked units one with respect to another, said nesting means comprising a symmetrically-arranged pair of diagonally-spaced protrusions and pair of diagonally-spaced depressions on said upper surface and a symmetrically-arranged pair of diagonally-spaced protrusions and pair of diagonally-spaced depressions on said lower surface, said depressions being complimentarily-shaped with respect to said protrusions and the symmetrical arrangement on said upper surface being complimentary with the symmetrical arrangement on said lower surface, said symmetrical arrangement on both said upper and lower surfaces being located wholly within and spaced inwardly from the periphery of the respective upper and lower surfaces; and fastening means associated therewith to permit said multiple of stacked flotation units to be stably joined one to another in a vertical stack of at least two face-abutted units, said fastening means comprising means establishing at least one connection point constructed to permit the connection point to be joined to the connection point on another flotation unit, said connection establishing means comprising a flange having an opening formed therethrough and two of said flanges are associated with each end wall and each side wall of said unit.

5. The flotation unit of claim 4 wherein depressions are provided in each end wall and each side wall of said unit and are terminated in the end wall by said flanges at the upper end thereof and in the side wall by said flanges at the lower end thereof.

* * * * *